US005209476A

United States Patent [19]

Eiba

[11] Patent Number: 5,209,476

[45] Date of Patent: May 11, 1993

[54] GAMING MACHINE AND OPERATING METHOD THEREFOR

[76] Inventor: Peter Eiba, Neuburger Strasse 144, D-8900 Augsburg, Fed. Rep. of Germany

[21] Appl. No.: 809,120

[22] Filed: Dec. 18, 1991

[30] Foreign Application Priority Data

Dec. 28, 1990 [DE] Fed. Rep. of Germany ..... 4042094

[51] Int. Cl.[5] ..... A63F 9/00

[52] U.S. Cl. ..... 273/138 A

[58] Field of Search ..... 273/138 A, 460

[56] References Cited

U.S. PATENT DOCUMENTS

| | | | |
|---|---|---|---|
| 4,335,809 | 6/1982 | Wain | 273/138 A X |
| 4,467,424 | 8/1984 | Hedges et al. | 273/138 A X |
| 4,531,187 | 7/1985 | Uhland | 273/138 A X |
| 4,611,808 | 9/1986 | Palmer | 273/138 A |
| 4,636,951 | 1/1987 | Harlick | 273/138 A X |

FOREIGN PATENT DOCUMENTS

| | | |
|---|---|---|
| 2636253 | 8/1976 | Fed. Rep. of Germany . |
| 3441518 | 11/1984 | Fed. Rep. of Germany . |
| 3415114A1 | 10/1985 | Fed. Rep. of Germany . |
| 3738120 | 11/1987 | Fed. Rep. of Germany . |
| 3820868 | 6/1988 | Fed. Rep. of Germany . |
| 3839977 | 11/1988 | Fed. Rep. of Germany . |
| 3802186A1 | 5/1989 | Fed. Rep. of Germany . |
| 4001985A1 | 7/1991 | Fed. Rep. of Germany . |

*Primary Examiner*—William H. Grieb

*Attorney, Agent, or Firm*—Lowe, Price, LeBlanc & Becker

[57] ABSTRACT

A gaming machine is provided with a time device permitting various data of previous games to be set into time relation and a display device for displaying the time-related data.

18 Claims, 1 Drawing Sheet

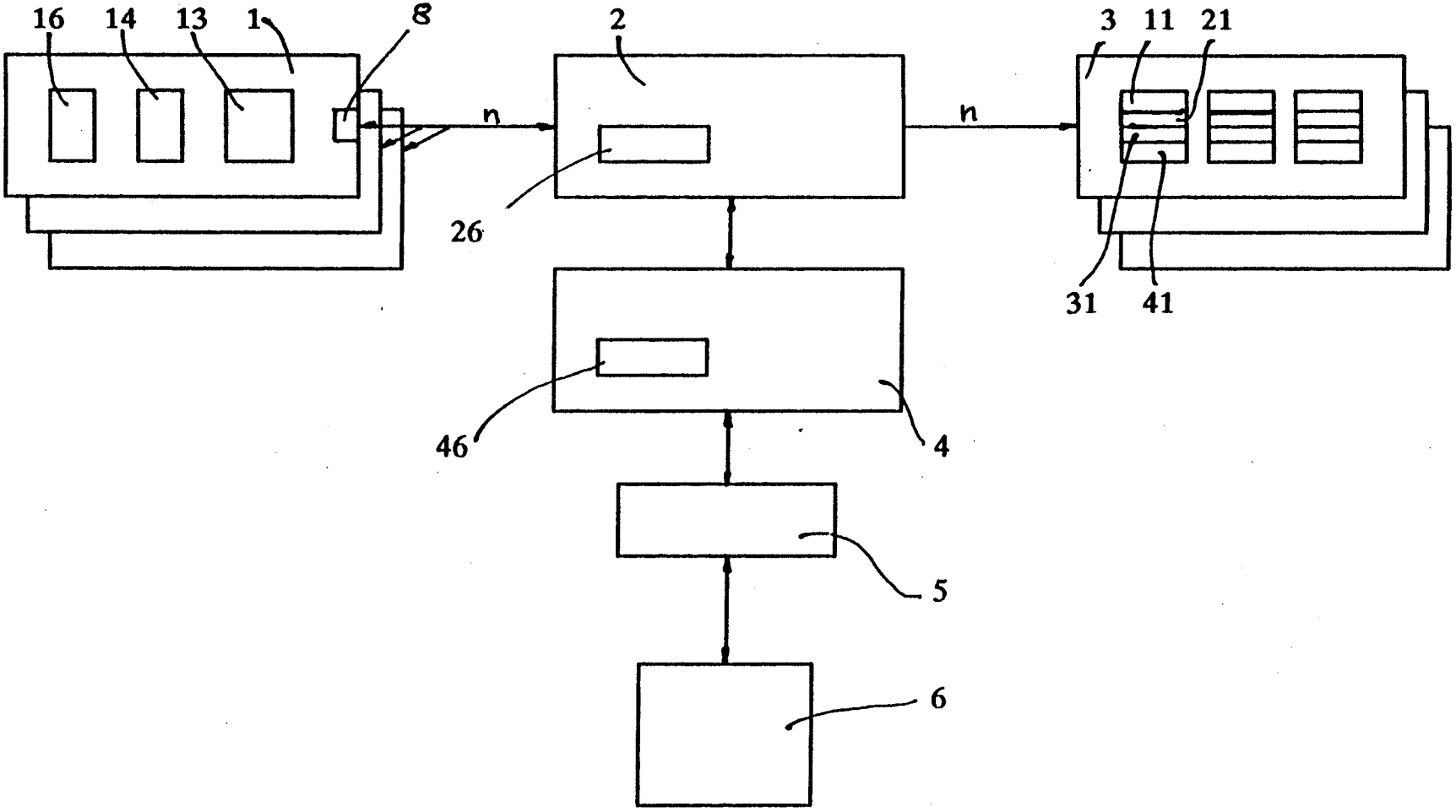
21
11
3
41
31
n
2
26
4
46
5
6
n
8
1
13
14
16

GAMING MACHINE AND OPERATING METHOD THEREFOR

FIELD OF THE INVENTION

The invention relates to entertaining apparatuses, in particular gaming machines, a system and a method for operating such apparatuses and machines.

BACKGROUND ART

It is generally known to provide gaming machines, in particular slot machines with display or indicating devices informing a player about the course and results of previous games. This information merely relates to the type number of events happened.

German Laid Open Patent Publication No. 37 38 120 discloses such a gaming machine provided with a device for indicating symbol combinations representing winnings or non-winnings. The machine is provided with two rows of LEDs parallel to each other with illuminated LEDs in one row indicating won games and illuminated LEDs in the other row indicating lost games for a number of previous games.

German Laid Open Patent Publication No. 38 39 977 discloses a gaming machine improved in respect of the gaming machine discussed before, provided with various display devices in the form of seven segment indicators displaying the stake of the machine, the stake of the player, the maximum amount involved comprising the sum of the two stakes per game, the number of special games, the winnings and the value of inserted coins.

U.S. Pat. No. 4,636,951 discloses a system for controlling the operation of gaming machines electronically connected with each other including communication between the machines and a central control unit using a central processing unit.

None of these known devices or machines is provided with a time measuring and/or displaying device.

German Laid Open Patent Publication No. 26 36 253 discloses a gaming machine provided with a clock controlling a microprocessor. However, this clock is only used as a switching element for switching on and off the operation of the machine, of an alarm device and of game incentive devices dependent on day-time. Nothing is said about time-related information to be determined and displayed.

German Laid Open Patent Publication No. 34 41 518 relates to a system using a larger number of gaming machines connected to a host computer provided with a day-time indicating device. However, this device only serves for modifying price and game time information read out from a ROM memory into the accumulator of the central processing unit of the gaming machine in order to have different tariffs depending on the time of the day.

SUMMARY OF THE INVENTION

It is an object of the invention to provide a gaming machine offering additional information about the courses and results of previous games.

It is a further object of the invention to provide a gaming machine offering additional information which may be advantageously used for monitoring and evaluating the operation of the machines.

It is a still further object of the invention to provide a system for operating a plurality of gaming machines offering useful additional information for each machine for indication to the players and for monitoring and evaluation of the operation of the machines.

It is a still further object of the present invention to provide a method for determining, indicating and evaluating additional information in gaming machines.

According to a first aspect the gaming machine of the invention comprises computing means for controlling said game; indicating means for indicating data about courses and results of previous games; time means connected to said computing means and enabling said computing means to set said data into relation to time; and display means for displaying said time-related data.

According to another aspect the system of the invention comprises control means connected to said gaming machines through interface means each for interrogating said computing means of said machines for reading out operational and result data from said computing means; time means; data processing means connected to said time means and receiving said data from said machines for setting them into relation to time; and display means for displaying said time-related data for each of said machines.

According to still another aspect the method of the invention comprises the steps of: a) computing data representative for courses and results of previous games performed by a player; b) setting said data in relation to time; and c) displaying said time-related data.

BRIEF DESCRIPTION OF THE DRAWING

The drawing is a block diagram of the system of the invention illustrating the control means used for controlling the gaming machines and appropriate display units.

BEST MODE OF CARRYING OUT THE INVENTION

Specifically, in the drawing there are indicated a number n of gaming machines 1 which may communicate through a controller 2 with a number n of display units 3 and/or a personal computer 4. If desired, computer 4 may transmit information through a modem or interface 5 to a central station 6 or receive information therefrom.

It should be noted that the details of the design of gaming machines, as regards the mechanical elements and the provision of electronic devices, as microcomputers for controlling the gaming machines are well known, as may be gathered from the publications referred to before, as U.S. Pat. No. 4,636,951.

Furthermore, German Laid Open Patent Publication 38 20 868 discloses a system for collecting gaming machine data from a plurality of gaming machines by a personal computer. Therefore, it is desisted here from explaining such details.

Now it is the basic idea of the invention that various information of interest for a player is not only provided as absolute values, e. g. a count of events, etc., but also as data related to time.

For example only as to such information the following aspects are indicated:

a) the course of the game, as series games, special games, etc., i. e. when or in what time frame such events happened;

b) extent of use of a gaming machine, i. e. information as how long, i. e. for what time and when the machine was used;

c) a pay-out coefficient, i. e. in what time period pay-outs or credits at what amount occurred.

Furthermore, from an operational aspect the following information may be of importance:

d) various statistics, as for instance in respect of errors, manipulations, idle games, machine break-downs and money irregularities occurred within a predetermined time period;

e) accounting, as for instance a time-related cash account permitting upon customer complaints about erroneous pay-outs an immediate check of the machine data and a determining of a possible difference amount.

All this information may be provided according to the invention by applying time to absolute values, as numbers and amounts, etc. This means in detail that by simple operations, as periodical scanning or monitoring of counters, by averaging and/or by divisions or any other more complicated operation, as the Gauβ' distribution, variance or the like, the desired information may be determined and made available for display and/or interrogation.

A time device 16, 26 or 46, preferably a battery-supplied electronic clock, dependent on the system, is provided either in the gaming machine 1 as such, in the controller 2 or in the computer 4. The first solution will be used for free-standing gaming machines, i. e. which are operated independent from any outside control. In this case, each gaming machine 1 has associated thereto or integrated therein a separate display unit 3 having corresponding display sections 11, 21, 31 and 41 for displaying the information indicated above in addition to any other information.

If several gaming machines 1 are connected together, preferably via controller 2 with computer 4, each gaming machine 1 is provided with a usual input/output unit 8 (see U.S. Pat. No. 4,636,951) for periodically interrogating or scanning the individual gaming machines 1, preferably in a serial manner. As mentioned before, each gaming machine 1 is provided in a well known manner with a microprocessor 13 and indicating or display means 14 for displaying usual, i. e. non-time-related information.

Controller 2 is of conventional design as well which will depend on the specific configuration of the system. It may be a simple MUX unit (see U.S. Pat. No. 4,636,951) when controlled by personal computer 4, specifically when the calculation of the time-related information is accomplished either in the gaming machine 1 or the personal computer 4. In the first case personal computer 4 may even be omitted, if controller 2 is provided with some control circuitry just for transmitted time-related information from gaming machine 1 to display unit 3.

Alternatively, all control and computation may be done in personal computer 4.

As mentioned before, each gaming machine 1 may have associated thereto a display unit 3 displaying either the time-related information of each gaming machine 1 individually or in common for a plurality of gaming machines 1. Additionally or alternatively, one or several display units 3 may be provided, for example, at an easily viewed place in the gambling room such that a player may select a gaming machine 1 he considers best in view of the indicated information.

The display unit 3 may have any desired design, as in the form of a monitor, a television set, or a projection screen. Alternatively, separate display devices 11, 21, 31, 41 may be used, as in the form of seven segment indicators, LED arrangements, or the like.

For example, a plurality of columns, display fields, or devices may be provided with each column being associated to one gaming machine 1 and having arranged therein in vertical order the display devices or fields 11 to 41.

If in a game system, as illustrated in the drawing, several gaming machines 1 are centrally controlled, time-related information as that indicated at item d) and e) above may be centrally captured, evaluated and, if desired, transmitted through modem 5 to a central station or host computer 6.

Accordingly, the invention provides an excellent opportunity for the players to gather additional information, i. e. time-related information for their gambling decisions.

It should be noted that the term time-related data means both data related to actual day-time and data related to a time period measured, e. g. in minutes.

Though the preceding explanations are mainly related to gaming machines, the invention is applicable as well for other entertaining apparatuses where time-related information may be of interest for the user. Therefore, the term "gaming machine" has such a broader meaning.

I claim:

1. A gaming machine operable by a player to initiate and perform a game with the machine comprising:

computing means for controlling said game;

indicating means for indicating data about courses and results of previous games;

time means connected to said computing means and enabling said computing means to set said data into relation to time; and display means for displaying said time-related data.

2. The machine of claim 1, wherein said machine is a free-standing machine and said display means is arranged separate therefrom.

3. The machine of claim 1, wherein said machine is a free-standing machine and said indicating means, said time means and said display means are integrated therein.

4. A system including a plurality of gaming machines, each operable by a player for initiating and performing a game, said gaming machines each including computing means, said system further comprising:

control means connected to said machines through interface means each for interrogating said computing means of said machines for reading out operational and result data from said computing means;

time means;

data processing means connected to said time means and receiving said data from said machines for setting them into relation to time; and display means for displaying said time-related data for each of said machines.

5. The system of claim 4, wherein said display means is a display device common for all of said machines and having arranged thereon groups of display fields associated to various of said data for each machine.

6. The system of claim 5, wherein said display device is a video device.

7. The system of claim 5, wherein said display device is a display screen means.

8. The system of claim 5, wherein said display fields are discrete digital indicating means provided for each of said data.

9. The system of claim 4, wherein said data processing means is a personal computer means.

10. The system of claim 4, wherein said time means is provided in said control means.

11. The system of claim 4, wherein said time means is provided in said data processing means.

12. A method for providing data desired in connection with the operation of gaming machines comprising the steps of:

a) computing data representative for courses and results of previous games performed by a player;

b) setting said data in relation to time; and c) displaying said time-related data.

13. The method of claim 12, wherein step b) is performed in said gaming machine.

14. The method of claim 13, wherein step c) is performed in said gaming machine.

15. The method of claim 12, wherein step b) is performed in a control means for a plurality of said gaming machines.

16. The method of claim 15, wherein step c) is performed with a display means common to all of said gaming machines.

17. The method of claim 12, wherein step c) is performed with a display means common to all of said gaming machines.

18. The method of claim 15, further comprising the step of:

d) transmitting said time-related data to a remote host processor means.

* * * * *